US008122670B2

(12) United States Patent
Matthee

(10) Patent No.: US 8,122,670 B2
(45) Date of Patent: Feb. 28, 2012

(54) SYSTEM FOR SETTING TILES, TILE ASSEMBLY AND JOINING ELEMENT FOR USE IN THE SYSTEM, METHOD FOR SETTING TILES, AND TILE FLOOR REPAIR METHOD

(75) Inventor: Richard Matthee, Heerlen (NL)

(73) Assignee: Handy Tiling Holding B.V., Heerlen (NL)

( * ) Notice: Subject to any disclaimer, the term of this patent is extended or adjusted under 35 U.S.C. 154(b) by 0 days.

(21) Appl. No.: 12/091,225

(22) PCT Filed: Oct. 31, 2006

(86) PCT No.: PCT/EP2006/010463

§ 371 (c)(1),
(2), (4) Date: Apr. 23, 2008

(87) PCT Pub. No.: WO2007/051591

PCT Pub. Date: May 10, 2007

(65) Prior Publication Data

US 2008/0271410 A1 Nov. 6, 2008

(30) Foreign Application Priority Data

Oct. 31, 2005 (EP) ..... 05077491
Jun. 6, 2006 (WO) ..... PCT/EP2006/005363

(51) Int. Cl.
*E04B 5/02* (2006.01)
*E04B 5/06* (2006.01)

(52) U.S. Cl. ..... 52/582.1; 52/403.1; 52/582.2; 52/562; 52/480; 52/747.11

(58) Field of Classification Search ..... 52/177, 52/385, 386, 403.1, 480, 506.06, 506.08, 52/511, 747.1, 747.11, 562, 571, 582.1, 582.2
See application file for complete search history.

(56) References Cited

U.S. PATENT DOCUMENTS

| | | | | |
|---|---|---|---|---|
| 841,998 | A | 1/1907 | Mulford | |
| 2,373,808 | A * | 4/1945 | Brown | 52/471 |
| 3,034,611 | A * | 5/1962 | Zenzic | 403/408.1 |
| 3,553,919 | A * | 1/1971 | Omholt | 52/506.1 |
| 3,731,445 | A * | 5/1973 | Hoffmann et al. | 52/391 |
| 3,862,874 | A | 1/1975 | Hopper et al. | |
| 5,907,934 | A | 6/1999 | Austin | |
| 5,934,729 | A * | 8/1999 | Baack | 296/39.1 |
| 6,233,886 | B1 * | 5/2001 | Andres | 52/177 |
| 6,763,643 | B1 * | 7/2004 | Mårtensson | 52/586.1 |

(Continued)

FOREIGN PATENT DOCUMENTS

DE 2105138 8/1972

(Continued)

*Primary Examiner* — Phi Dieu Tran A
(74) *Attorney, Agent, or Firm* — Hoffmann & Baron, LLP

(57) ABSTRACT

A system for setting tiles uses a number of tile assemblies and joining elements (21*a*) interconnecting adjacent tile assemblies. Each tile assembly—has a tile member (3*a*) and a support member. The support member is connected to the underside of the tile member, and is provided with recesses for accommodating parts of the joining elements. The support member has a number of openings and/or projections (12*a*) extending in a direction perpendicular to a main surface of the tile member. The joining element has an elongate strip-like member provided with openings (30*a*) and/or projections fitting into corresponding projections and/or openings of the support members of two adjacent tile assemblies.

29 Claims, 9 Drawing Sheets

U.S. PATENT DOCUMENTS

| | | | | |
|---|---|---|---|---|
| 6,862,855 | B1 * | 3/2005 | Milum et al. | 52/384 |
| 6,925,764 | B2 * | 8/2005 | Hrovath et al. | 52/390 |
| 6,966,161 | B2 * | 11/2005 | Palsson et al. | 52/589.1 |
| 7,908,819 | B2 * | 3/2011 | Neuhofer, Jr. | 52/747.1 |
| 2004/0216421 | A1 | 11/2004 | Poliacek et al. | |
| 2005/0028474 | A1 * | 2/2005 | Kim | 52/578 |
| 2005/0144875 | A1 * | 7/2005 | Lenhard-Backhaus et al. | 52/506.01 |
| 2005/0166513 | A1 | 8/2005 | Vanderhoef | |
| 2005/0210809 | A1 | 9/2005 | Nevison | |
| 2007/0220822 | A1 | 9/2007 | Permesang | |

FOREIGN PATENT DOCUMENTS

| | | | |
|---|---|---|---|
| DE | 41 40 683 | A1 | 6/1993 |
| DE | 297 04 697 | U1 | 8/1998 |
| EP | 0 857 839 | A2 | 8/1998 |
| FR | 2 395 371 | | 1/1979 |
| GB | 1 350 754 | | 4/1974 |
| RU | 2008119080 | | 10/2006 |
| WO | WO 03/105654 | A1 | 12/2003 |
| WO | 2005040521 | A2 | 5/2005 |

* cited by examiner

SYSTEM FOR SETTING TILES, TILE ASSEMBLY AND JOINING ELEMENT FOR USE IN THE SYSTEM, METHOD FOR SETTING TILES, AND TILE FLOOR REPAIR METHOD

CROSS-REFERENCE TO RELATED APPLICATIONS

This application is the National Stage of International Application No. PCT/EP2006/010463, filed Oct. 31, 2006, which claims the benefit of European Application No. 05077491.8, filed Oct. 31, 2005 and International Application No. PCT/EP2006/005363, filed Jun. 6, 2006, the contents of which are incorporated by reference herein.

FIELD OF THE INVENTION

The invention relates to a system for setting tiles using a number of tile assemblies and joining elements interconnecting adjacent tile assemblies, each tile assembly comprising a tile member and a support member, the support member being connected to the underside of the tile member and being provided with recesses for accommodating parts of the joining elements. The invention further relates to a tile assembly and a joining element for use in the system. The invention still further relates to a method for setting tiles, and a tile floor repair method.

BACKGROUND OF THE INVENTION

A system is known from U.S. Pat. No. 5,323,575. In this known system the support member is provided with connecting elements designed in such a way that one tile assembly comprising a tile member and a tile support can be releasable connected to an adjacent tile assembly. In this way a complete tile floor can be made by interconnecting such tile assemblies. The construction, however, is such that once the floor has been completed it is extremely difficult to remove a single tile assembly without damaging the tile in a non-reparable way. This is due to the fact that the connection is made by male and female elements which are alternately used on each tile assembly. Therefore it is difficult to replace a single tile or a restricted number of tiles without a substantial damage to a number of tile assemblies.

SUMMARY OF THE INVENTION

It is an object of the invention to provide a system as described above in which these problems are avoided.

This object is achieved in that the support member has a number of openings and/or projections extending in a direction perpendicular to a main surface of the tile member, and in that the joining element comprises a strip-like member provided with openings and/or projections fitting into corresponding projections and/or openings of the support members of two adjacent tile assemblies.

By providing a separate joining element it becomes possible to simply remove a single tile assembly from a location in a completed floor by vertical lifting of this tile assembly, e.g. for cleaning, or replacement in case of damage, thereby releasing the connection (e.g. by friction) between the projections and/or openings of the tile assembly and the openings and/or projections of the joining elements. The same or another tile assembly may then be simply placed at the same location to complete the floor again. In fact, the whole tile floor may be laid and removed quickly, without changes or damage to an underfloor, to the tile assemblies, or to the joining elements. The tiling according to the present invention reduces the required amount of labour substantially. The tile assemblies and joining elements may be reused many times, making the system according to the present invention particularly suitable for use on fairs, exhibition grounds, flexible living and office space, etc.

In an embodiment, part of the tile assembly overlies part of the joining element. The interacting projections and/or openings are located in said parts near edges of the tile assembly and the joining element, respectively.

In an embodiment, the openings and/or projections of the support member are located in the recesses of the support member.

In an embodiment, the recesses are located under the tile member, so as to enable the joining element to be located substantially under the tile member, and thereby become at least partly, or wholly, invisible when a floor made up of the tile assemblies and joining elements is completed.

In an embodiment, the openings and/or projections are arranged in a row along the edges of each support member and joining element. Thus, with a low amount of material a reliable connection along a line can be made. Tile assemblies may be placed with full edges facing each other, or shifted relative to each other over one or more opening and/or projection pitches, if the openings and/or projections are spaced uniformly in said row.

In an embodiment, the projection has a substantially cylindrical shape, the projection being configured to be inserted into an opening having a substantially cylindrical shape, the opening having an inlet part with a substantially conical shape. During insertion of the projection, the wall of the conically shaped inlet part of the opening will guide the projection into the cylindrical part of the opening, thereby moving the projection transversely relative its direction of extension, so that also the tile assembly and the joining element are moved in this direction relative to each other until the projection is in the cylindrical part of the opening.

In an embodiment, the projection has a tapering shape, the projection being configured to be inserted into an opening having a corresponding tapering shape. During insertion of the projection, the wall of the tapering opening will guide the projection into the opening, thereby moving the projection transversely relative its direction of extension, so that also the tile assembly and the joining element are moved in this direction relative to each other until the projection is fully in the opening.

As is discussed in more detail below, the joining element may be made from an elastically deformable material, and the support element may be made from a substantially undeformable material. In such embodiment, the support member is provided with the projections, and the joining element is provided with the openings.

In an embodiment, the joining element is configured to extend along part of the circumference of the tile assembly. Where a joining element has a plurality of edges, the joining element extends along at least one of said edges.

In an embodiment, the joining element is configured to extend along half the circumference of the tile assembly. A complete floor may be tiled with one type of tile assembly and one type of joining element resulting in a low total number of components (joining elements and tile assemblies). The tile member/tile assembly may be triangular, rectangular, square, or generally polygonal, such as hexagonal.

In an embodiment, the joining element is made from an elastically deformable material. Such material provides flexibility when connecting the joining element and a tile assembly, yet ensuring a proper connection. Such material may also be used to generate a force in a connection between projections and openings in a direction of the main surface of a tile member, by stretching the material. Such material further may generate a high friction against sliding of the joining element relative to an underfloor, thereby essentially fixing the tile assemblies interconnected by the joining elements against movement parallel to the main surface of the tile members relative to the underfloor. Such material may also provide a seal with respect to an underfloor to prevent a liquid inadvertently reaching under a tile assembly, e.g. through a crack in a tile, from spreading from under one tile assembly to under an adjacent tile assembly, provided that the joining elements being connected to said one tile assembly are in contact with each other to also provide a closed circumferential seal.

In an embodiment, the openings and/or projections of the tile assemblies and the joining elements are configured such that with a joining element interconnecting adjacent tile assemblies, the joining element is deformed, thereby urging the tile members of the adjacent tile assemblies towards each other. If edges of adjacent tile members contact each other, the deformation of the joining element generates tensile forces therein urging the edges of the adjacent tile members against each other. In such a way, dimensional changes of the tile members, which may e.g. be made of wood, are automatically compensated for, in that no gaps between adjacent tile members may arise. Tile members may be urged against each other such that essentially no liquid may pass between the tile members, thereby making the floor liquid-tight. Additionally, the tile members may be provided with an elastically deformable material on their faces contacting adjacent tile members to enhance a sealing effect against liquid.

In an embodiment, the joining element is provided with an upwardly extending joint part configured to be arranged between two adjacent tile members. The joint part fills at least part of a gap between adjacent tile members, thereby avoiding a conventional grouting of the gap after tiling.

For a sealing effect, in particular a sealing against liquid, in an embodiment the joint part is made of an elastically deformable material. The system can be designed such that the joint part is deformed after interconnecting the tile assemblies and the joining elements.

The joint part of the joint part may be a separate part, possibly provided with means to connect it to the joint part. However, in an embodiment, the joint part is integral with the joining element.

In an embodiment, a top part of the joint part is tapered or rounded. Such an embodiment facilitates a placement of a single tile assembly in an otherwise complete floor.

In an embodiment, the openings and/or projections of the tile assemblies and the joining elements are configured such that with a joining element interconnecting adjacent tile assemblies, the joining element is deformed, thereby urging the tile members of the adjacent tile assemblies towards the joint part. Thus, the joint part, possibly provided with sealing protrusions, is compressed, thereby obtaining excellent liquid-tightness properties for the tile floor.

In an embodiment, the joining element, in particular but not exclusively a joint part thereof, is provided with a protrusion on a side configured to face a tile member, the protrusion extending along the length of the joining element. The protrusion may bring about a sealing effect against a liquid.

In an embodiment, the protrusion is compressible, for an enhancement of the sealing effect. The protrusion may be elastically deformable.

In an embodiment, the joining element is configured to have a bottom side lying essentially flush with a bottom side of the support member, thus providing an excellent support of a tile floor composed by the system of joining elements and tile assemblies. Further, in this way a high friction between the tile floor and an underfloor is reached, thereby effectively preventing the tile floor to slide relative to the underfloor. In an embodiment, the tile member comprises a substantially undeformable tile, e.g. made from stone, ceramics, wood, plastic, glass, metal, or any combination thereof. A substantially undeformable tile may function well in combination with a deformable joint part to provide a required sealing.

In an embodiment, the tile at its lower edges is tapered or rounded. Such an embodiment facilitates a placement of a single tile assembly in an otherwise complete floor, e.g. while repairing a damaged or worn tile assembly/tile.

In an embodiment, the tile member comprises a deformable tile, such as a rubber tile or a carpet tile. Adjacent deformable tiles may be placed with their edges in contact with each other, so that joining elements, having no joint parts, are invisible when the floor is complete.

In one floor, tile members of different types may be combined, using the same joining elements, or using joining elements with joint parts on the one hand (e.g. for a floor section set with stone or ceramic tiles) and joining elements without joint parts on the other hand (e.g. for a floor section set with wooden or carpet tiles).

If the joining element is provided with an upwardly extending joint part configured to be arranged between two adjacent tile members, in an embodiment the tile member may comprise a layered structure of a lower substantially undeformable tile and an upper tile, the upper tile overlying at least part of the joint part. When considering two adjacent tile members, each of the upper tiles may overlie half of the joint part.

In an embodiment, between the tile member and the support member a liquid-tight material is provided. Should the tile member lose its liquid-tightness, e.g. as a result of the tile member breaking, then the liquid-tight material, such as a foil, may prevent the liquid to pass under the tile assembly.

According to the present invention, a method for setting tiles comprises: providing a number of tile assemblies; providing a number of joining elements; connecting at least one joining element to each tile assembly to provide pre-assembled tile-setting components; and interconnecting said pre-assembled tile-setting components to obtain a tile floor.

A method for repairing a tile floor comprising a number of tile assemblies interconnected with a number of joining elements comprises: releasing the connections between a tile assembly and corresponding joining elements in the tile floor by lifting the tile assembly from the tile floor, leaving a tile assembly opening in the tile floor; and inserting a tile assembly in the tile assembly opening, thereby connecting the tile assembly to said corresponding joining elements.

BRIEF DESCRIPTION OF THE DRAWINGS

Other features and advantages of the invention will become clear from the following description of exemplary embodiments, with reference to the attached drawings, wherein.

DETAILED DESCRIPTION OF PREFERRED EMBODIMENTS

Figure 1:
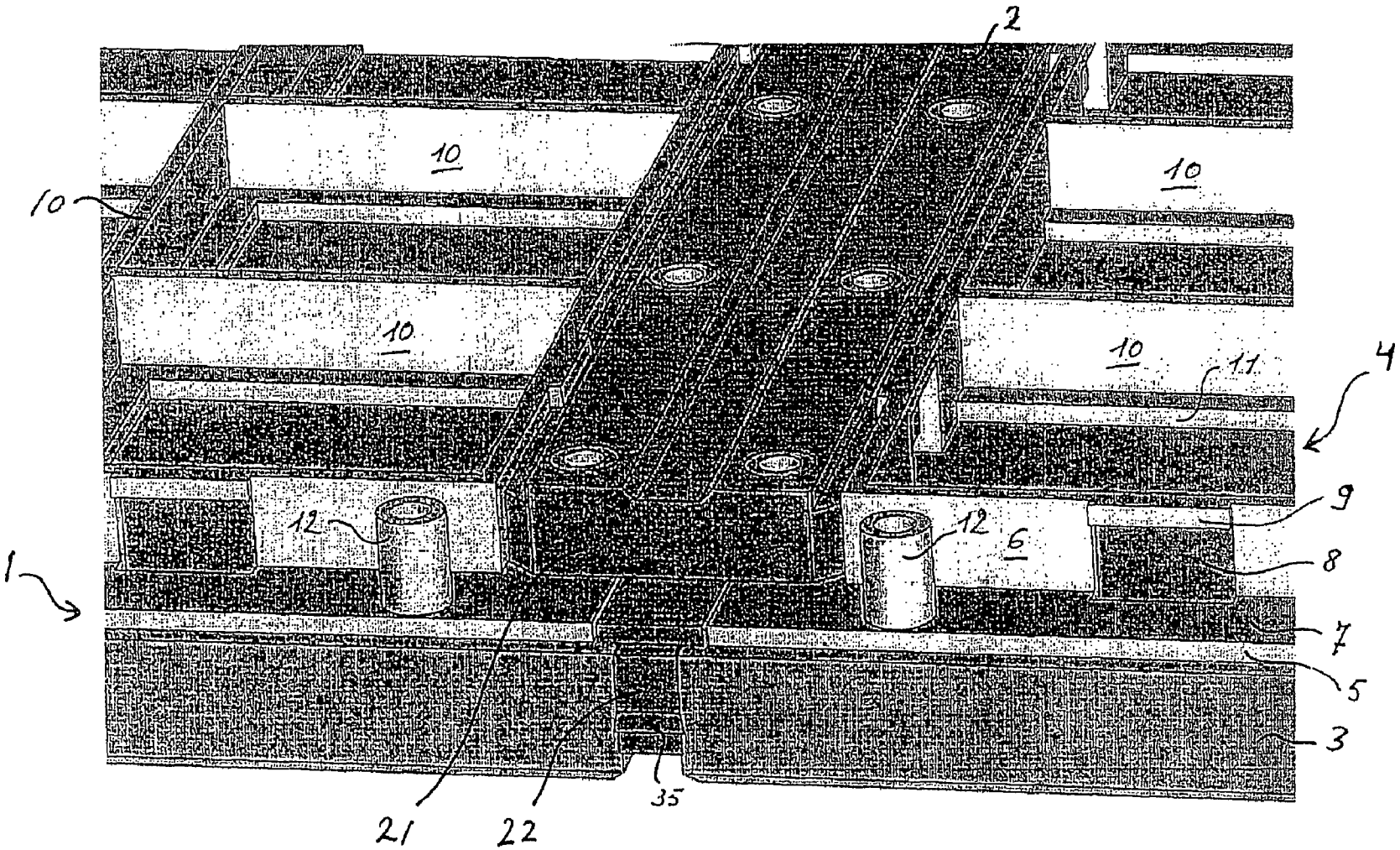
FIG. 1 shows a bottom view of a few tiles set by means of the system according to the invention.

In the different Figures, the same reference numerals indicate the same or a similar component.

Referring to FIGS. 1-4, a tiling system according to the invention comprises in principle two basic members, a tile assembly 1 and a joining element 2 enabling a complete tiled floor to be made through joining a number of each of these members in an appropriate manner.

The tile assembly 1 comprises a tile or tile member 3 and a support member 4 fixed to the bottom side of the tile. The tile member 3 may have any proportion and size in current use in tiling, with the size of the joining element 2 being adapted accordingly for use in combination. In the following description, a square tile is assumed, but it is possible to use rectangular tiles or even other polygonal ones, such as e.g. triangular or hexagonal tiles.

Figure 2:
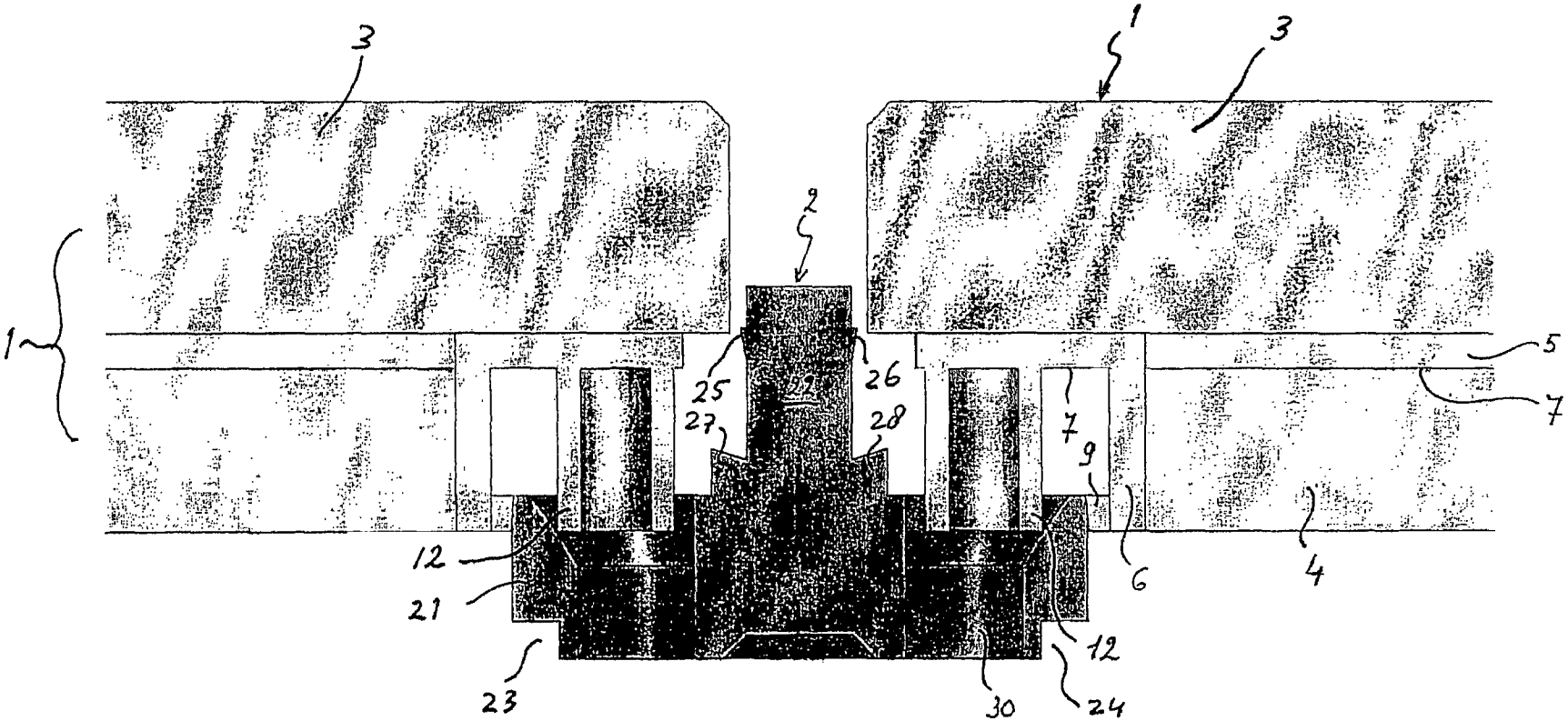
FIG. 2 shows a schematic sectional view of two tile assemblies and a joining element according to the invention, before joining.
Figure 3:
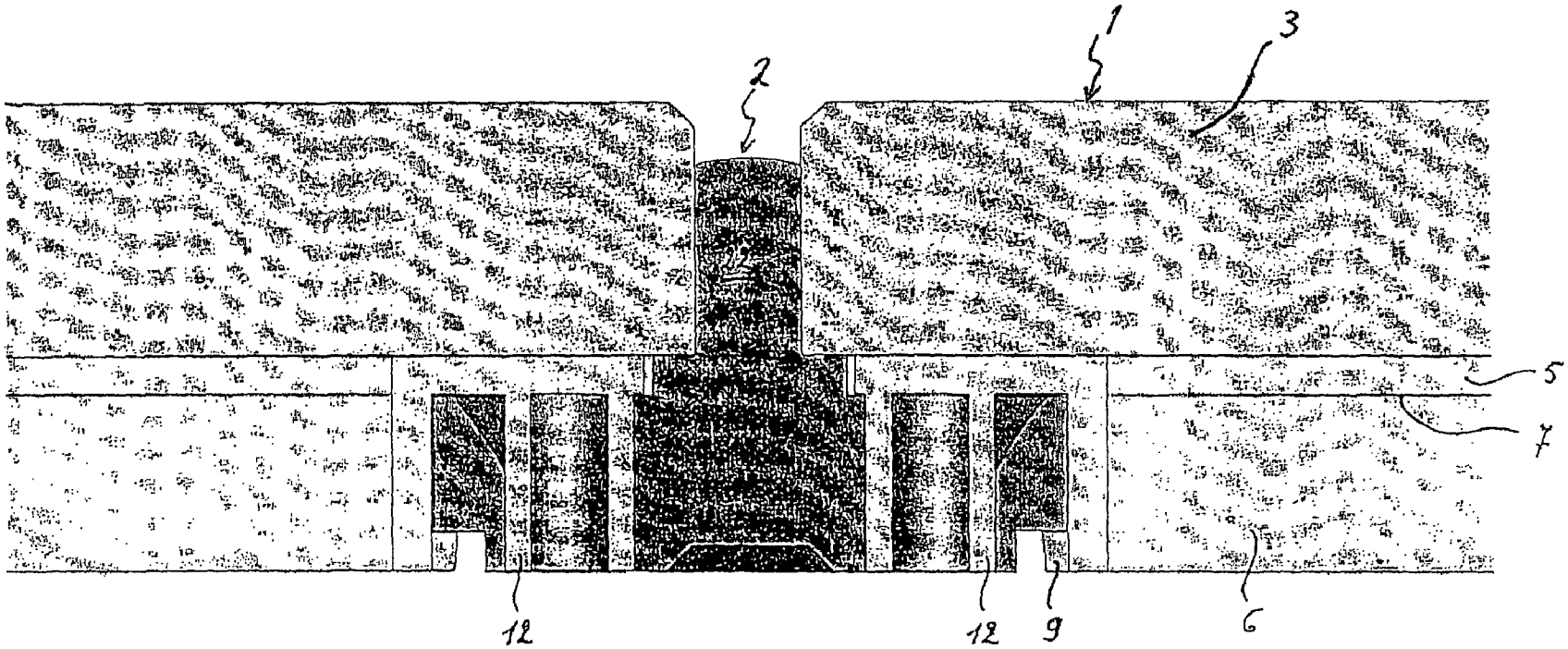
FIG. 3 shows a schematic sectional view, corresponding with FIG. 2, after joining the respective tile assemblies.

As shown in the FIGS. 2 and 3, the tile member 3 has a customary shape and can be provided with a somewhat slant edge on the top side in order to prevent damage during tiling and during use of the resulting floor.

In the depicted embodiment as shown in FIGS. 1-3, the support member 4 comprises a square plate 5 which has a surface area slightly smaller than that of the bottom side of the tile member 3 and which is attached to it, e.g. by means of an adhesive. Perpendicularly to the plane of the square plate 5, a raised edge 6 extends, which, when viewed in the direction of the plane of the tile member 3, has a square shape having an external dimension which is smaller than that of the plate 5, thus constituting a peripheral edge 7 which extends beyond said edge 6. At regular distances, the edge 6 is provided with openings 8 of an essentially rectangular shape between the plate and a top edge 9 which juts out a little more with respect to the outer surface of the edge 6. The edges 6 and 7 delimit a recess of the support member 4.

Between the inner edges of every two opposite parts of the edge 6, there are provided several cross connections in the form of intermediate walls 10, each being parallel to a part of the edge 6 and, accordingly, to an edge of the tile member 3. The height of the intermediate walls in the direction perpendicular to the surface of the tile member 3 is equal to the height of the edge 6. At the level of a connecting line between any intermediate wall 10 and the plate 5, a thickening 11 is provided, and that on both sides of each intermediate wall. These thickenings extending over the entire length of the intermediate wall 10 have a rectangular or square section, as viewed in a direction crosswise to the longitudinal direction of the thickening 11. This causes the connections of the intermediate walls 10 with the plate 5 to be stiffened.

On the peripheral edge 7 and in a direction perpendicular to the surface of the plate 5 or the bottom side of the tile member 3, a plurality of projections 12 in the form of hollow cylinders is provided. The projections 12 are arranged in a row, and are evenly distributed over the contour of the support member 4, which means that the mutual distance between two successive projections 12 situated along the same side edge of the plate 5 is invariably the same. As is clearly illustrated in FIG. 1, in the corner portion of the connecting member there is not a projection 12, but the extreme projection 12 of a support member 4 is provided in the position where an end of the edge 6 is situated. The whole support member 4, comprising the plate 5, edge 6, intermediate walls 10 with thickenings 11 and projections 12, may be made as an entity, but it is also possible to have it made as separate units, subsequently connected to each other in a suitable manner. The latter may present the advantage that for the respective members various materials may be used, each matched with the function of the member in the whole. The plate 5 may or may not be provided with holes in regions between the intermediate walls 10.

In use, the tile member 3 essentially rests on a ground through the edges 6 and the intermediate walls 10.

As viewed in a longitudinal direction (and further explained below by reference to FIGS. 5 and 6), the joining element 2 in FIGS. 1-4 comprises a moulding 20 in the form of an "L" such that it is capable of extending along two edges of a tile assembly 1 in connection to each other. However, the moulding 20 may also be in the form of an "|" extending along an edge of a tile assembly 1 or a part thereof.

The moulding 20 has a "T"-shaped cross-section, which in normal use as a joining element between (two) tile assemblies 1 has the "T" positioned upside down i.e. a crossbeam 21 is under a central beam 22 (also referred to as a joint part) of the "T". The crossbeam 21 has a rectangular section and is provided with two recesses 23 and 24 near two angular points of the crossbeam 21, the function of which will be described hereinafter. The central beam 22, too, has a rectangular section and on either side it is provided with a protrusion 25, 26, which extends along the whole length of the joint part, and has a section in the form of a right-angled triangle of which the oblique side is facing down in FIG. 4.

Near the connection between the crossbeam 21 and the central beam 22, on either side of the central beam 22 there is provided a protrusion 27, 28, in the embodiment shown, each having a section in the shape of a right-angled trapezium of which the shorter one of the parallel sides is connected with the central beam 22 and the oblique side is the top edge in a normal application of the joining element.

Figure 4:
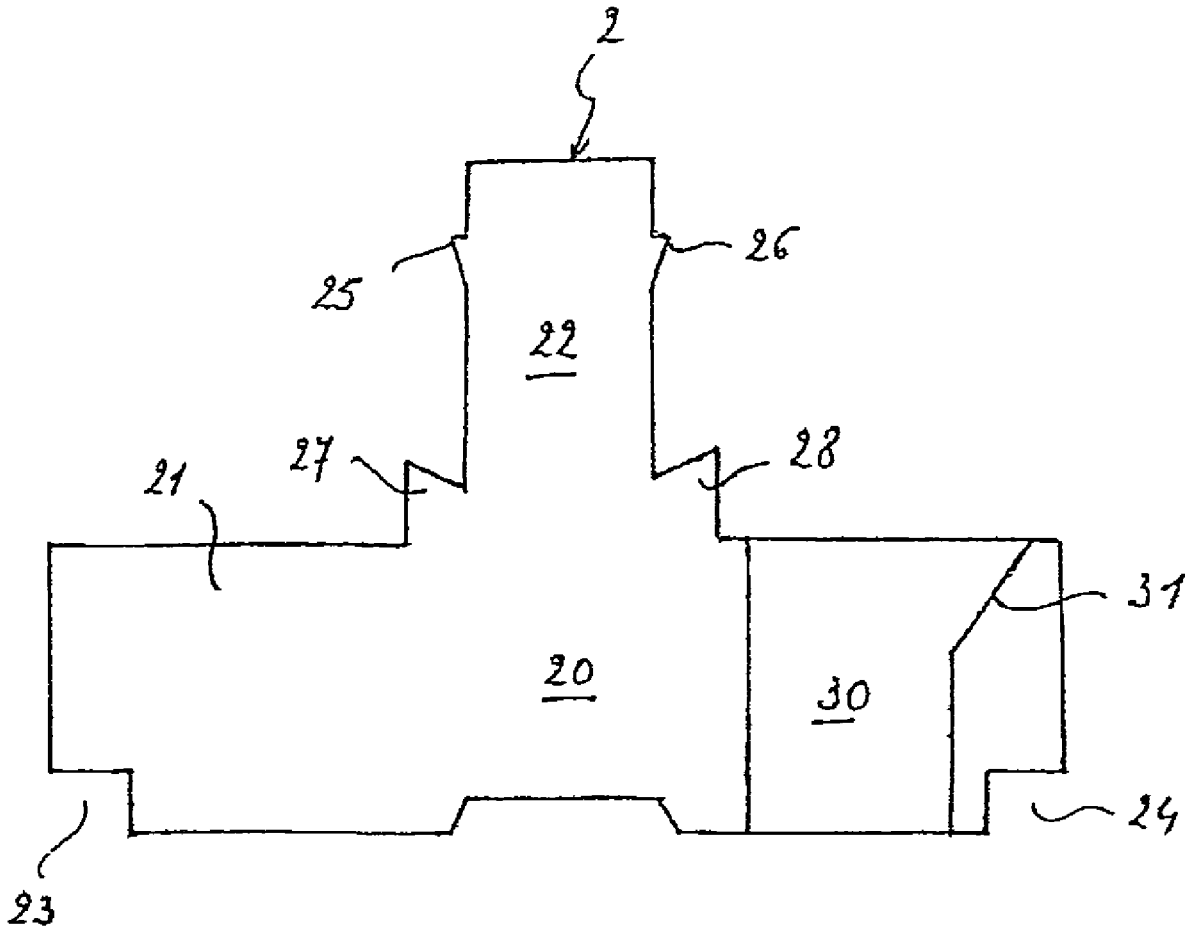
FIG. 4 shows a cross-sectional view of a joining element in a direction perpendicular to a longitudinal direction of the joining element of FIGS. 2 and 3.

Along the length of the joining element 2, a plurality of openings 30 is provided in the crossbeam 21, on either side of the central beam and at an even distance from each other. Generally, the openings 30 are of a cylindrical shape. FIG. 4 shows only one opening 30. Near the top end (inlet part) of each cylindrical opening 30, half the wall portion 31 (the more distant one from the central beam 22) is obliquely widened in an upward direction in such a way that near the top end the opening has a virtually oval shape, i.e. near the top end, the edge of the opening is defined by two half circles interconnected by two straight (parts of) lines. The distance between two neighboring openings 30 on the same side of the central beam 22 is equal to the distance between two neighboring projections 12 of the support member 4.

The joining element 2 is made of an elastic material, particularly a rubber-like material, such as natural or synthetic rubber, or a synthetic material having rubber-like characteristics, such as EPDM-rubber or the like. Just like the support member 4, the joining element 2 may be made as a whole or be composed of various units connected with each other in a suitable manner.

The procedure of setting the tiles by means of the components described above is as follows. Initially, a situation is assumed in which the user has the various parts, the tile assembly 1 and the joining element 2, as separate components at his disposal.

In a first step, a tile assembly 1 is pressed onto a joining element 2. In doing so, the projections 12 are fed into the openings 30. During this motion, the tile assembly 1 is pushed towards the central beam 22 of the joining element 2 as a result of the oblique wall portion 31 in the openings 30. At the time when the tile assembly 1 has moved sufficiently towards the central beam 22, the protrusion 26 is compressed, and when the tile assembly 1 with its projections 12 has been pushed fully into the openings 30, the oblique side of the trapezoidal protrusion 28 is also pushed away. Due to a suitable choice of the dimensions of the different parts of the tile assembly 1 and the joining element 2, the recess 24 is positioned behind the edge 9 of the opening 8. So, the tile member 1 and the joining element 2 are rigidly attached to each other, although they may be released from each other without undue force in case the joining element 2, in particular the crossbeam 21, is made from deformable material.

By pushing the protrusions 26 and 28 away a good watertightness between the joining element 2 and the tile assembly 1 is obtained. The tile assembly 1 that has been connected to the joining element 2 to form a pre-assembled tile-setting component, and thus has been provided with two sealings along two matching edges of the tile member 3, can subsequently be put into its proper place on the previously prepared underfloor or ground. Subsequently, a second tile assembly 1 and a second joining element 2 can be connected with each other in the above manner to form a second pre-assembled tile-setting component.

When this second pre-assembled tile-setting component comprising a tile assembly 1 and a joining element 2 is completed, this second pre-assembled tile-setting component can be connected with the first pre-assembled tile-setting component by pressing the projections 12 of the support member 4 of the second pre-assembled tile-setting component (not along an edge of the tile assembly 1 provided with a joining element 2) into openings 30 of a joining element 2 of the first pre-assembled tile-setting component, creating a fixed connection between the tile assembly of the second pre-assembled tile-setting component and the joining element 2 of the first pre-assembled tile-setting component in the same way as described above. By this method the entire floor area may be covered, of course, on the understanding that the user has to make the appropriate choice as regards the orientation of the pre-assembled tile-setting components.

Due to the fact that in a longitudinal direction the joining elements 2 are L-shaped, the situation at a corner is automatically in proper order, i.e. the connection of the two tile assemblies 1 with regard to liquid-tightness and fit is ensured.

To ensure that the connection at the other corners is also correct, the design of the joining element 2 near the far end of each leg of the L-shape is as described hereinafter.

As shown in FIG. 1, the crossbeam 21 of the joining element 2 does not extend farther than the edge 6 of the support member 4. The central beam 22 of the same joining element 2, however, extends as far as the edge of the tile member 3 which is parallel to the edge 6, with the protrusions 27, 28 being slightly shorter than, and being in line with the edge of the plate 5, which is slightly smaller than the tile member 3, as described above. An end wall of the central beam 22 is provided with a triangular protrusion 35 which has the same shape and orientation as the triangular protrusions 25, 26.

If a subsequent row of pre-assembled tile-setting components, with each pre-assembled tile-setting component consisting of a tile assembly 1 and a joining element 2, is added to the pre-assembled tile-setting component already set, then a joining element 2 of these added pre-assembled tile-setting components will abut against the end of a joining element 2 of a pre-assembled tile-setting component already set. In case the tile assemblies are being set in a certain pattern with continuous joints, a corner part of a joining element 2 comes into touch with an end face of a joining element already present, so that the protrusion 35 comes to lie in opposition to a part of a protrusion 25 and thus may form a watertight connection which, in addition, is practically seamless. In case a staggered pattern of tile assemblies 1 is chosen, the same effect is obtained.

It will be obvious that the invention is not limited to the embodiment described and depicted, but that within the scope of the claims numerous alterations may be made without departing from the inventive idea. Accordingly, in particular it is possible to realize the shape of the projection 12 and openings 30 in a different manner. In principle, it is even feasible to design them as a through-hole and a continuous groove. Moreover, it is feasible here to apply a mechanical reversal, in which the openings have walls perpendicular to the plane of the tile assembly, while the projections have tapered walls. Of course, it is also possible to give the protrusions 25, 26 such a different shape that the requirements for a watertight sealing and smooth motion of joining element and tile assembly are also fulfilled. This may be achieved, e.g. by designing the protrusions 25, 26 as triangular members in the form of an isosceles triangle which has a wide apex angle and the base of which is connected with the central beam 22.

Figure 5:
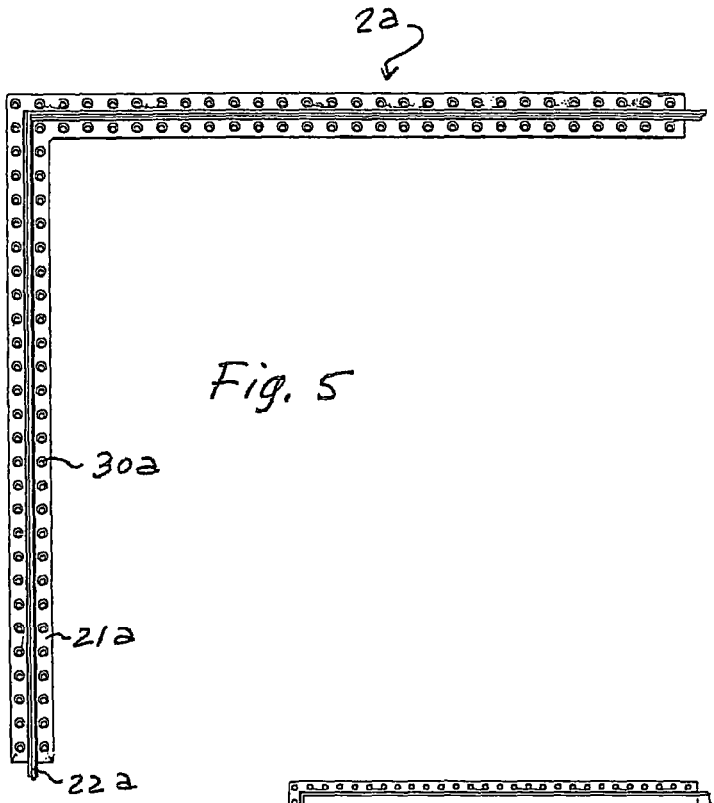
FIG. 5 shows a top view of a joining element according to the present invention.
Figure 7:
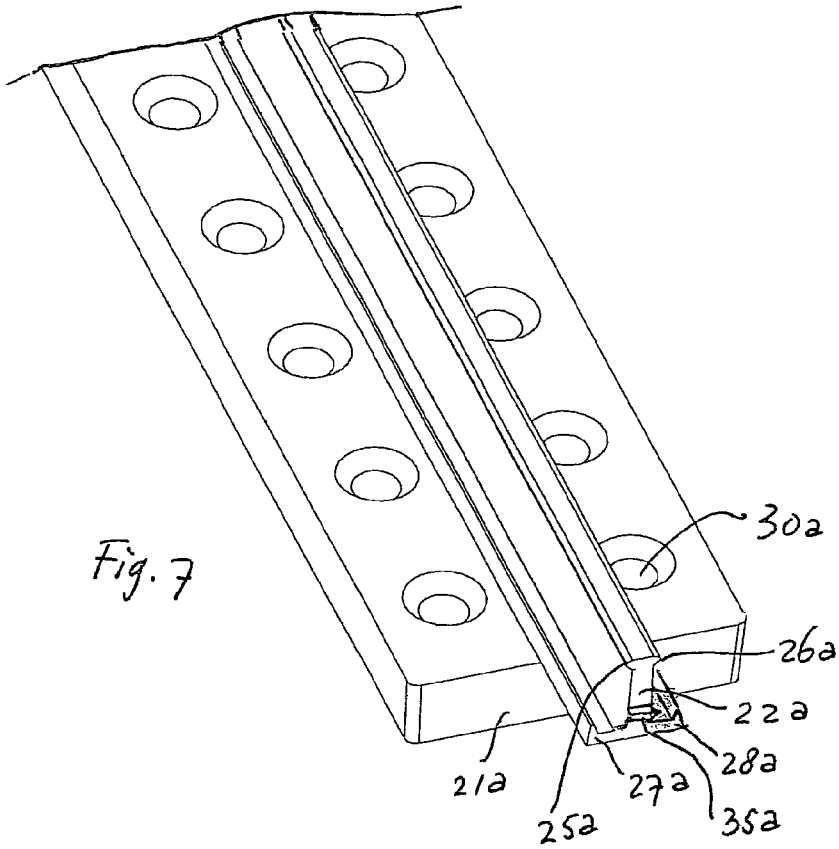
FIG. 7 shows a perspective view of the joining element of FIG. 5.

Referring to FIGS. 5 and 7, a joining element **2*a* is an elongate part which in an embodiment is in the form of an L as seen in its longitudinal direction. The joining element 2*a* has a generally T-shaped cross-section comprised of a crossbeam 21*a* and a central beam 22*a* positioned along a center line of the crossbeam 21*a*. Along opposite longitudinal edges of the crossbeam 21*a*, a row of openings 30*a* is provided, adjacent openings 30*a* in a row being spaced apart at a constant pitch. Each opening 30*a* comprises a tapering, e.g. conical inlet part at its end to be facing a tile assembly. Each opening 30*a* has a cylindrical shape adapted to accommodate a projection of a tile assembly, in particular a support member thereof, in a tight manner, such as to hold the projection in the opening 30*a*** by friction.

The ends of the central beam **22*a* of the joining element 2*a*, at both ends of the crossbeam 21*a* of the L-shaped joining element 2*a*, project from the crossbeam 21*a*, so that the central beam 22*a* extends along the lengths of two sides of a tile member, as will be further explained by reference to FIG. 6. At the same time, the crossbeam 21 is shorter than the lengths of the sides of a tile member, to allow the ends of a crossbeam 21 to rest against other parts of other crossbeams 21** without interference.

The crossbeam **21*a* may be formed integral with the central beam 22*a* from a deformable, in particular elastically deformable material. However, the crossbeam 21***a* may also be formed as a separate part from the central beam 22*a*, and/or each from a different material, to be joined in a suitable manner which will not be described in detail.

The central beam 22*a*, when seen in cross-section, may be slightly tapering in a direction away from the crossbeam 21*a*. At its end facing away from the crossbeam 21*a*, the central beam 22*a* is provided with transverse protrusions 25*a*, 26*a* having a tapering free end, while adjacent to the central beam 22*a* and the crossbeam 21*a*, protrusions 27*a*, 28*a* are provided being generally L-shaped, having a tapering free end. At each end of the central beam 22*a*, a protrusion 35*a* may be provided, having a tapering free end. The protrusions 25*a*, 26*a*, 27*a* and 28*a* generally extend along the length of the central beam 22*a*.

Figure 6:
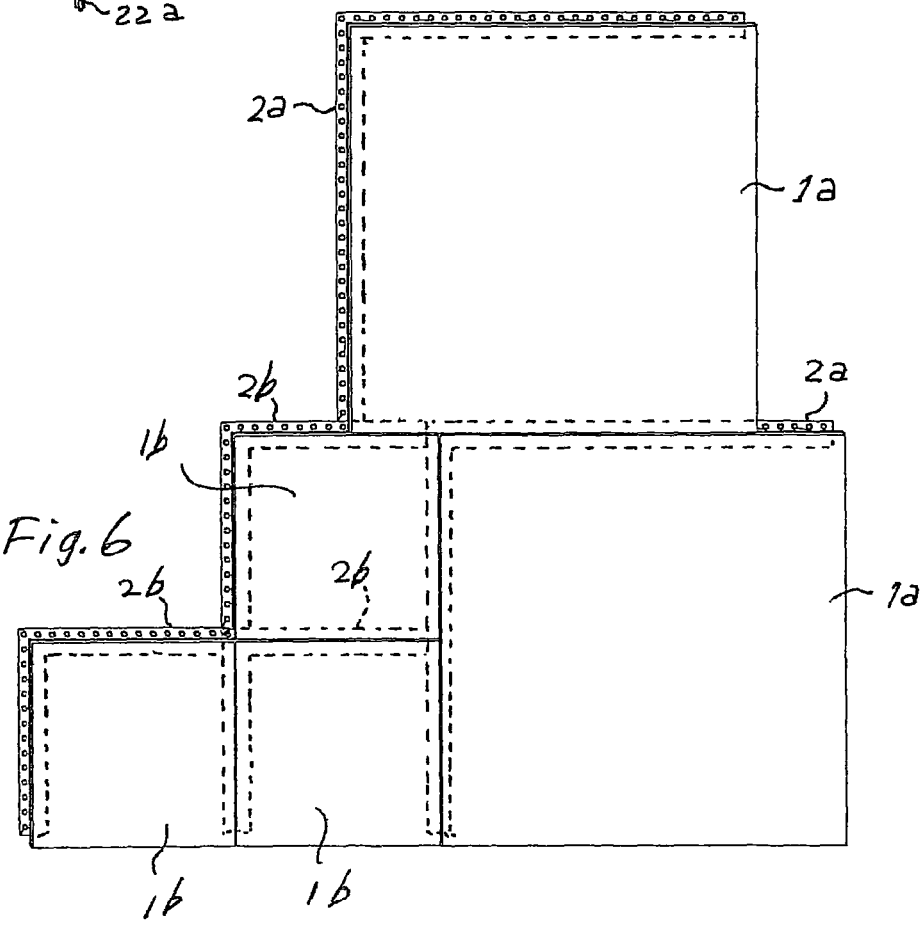
FIG. 6 shows a top view of a section of a floor having square tile assemblies according to the present invention having two different sizes, and interconnected by joining elements of two different sizes extending along half the circumference of the respective tile assemblies.

Referring to FIG. 6, a number of tile assemblies 1*a*, 1*b* have been connected to each other through joining elements 2*a* and joining elements 2*b*, where joining elements 2*a* each extend along two sides (i.e. half of the circumference) of a rectangular tile assembly 1*a*, and joining elements 2*b* each extend along two sides (i.e. half of the circumference) of a rectangular tile assembly 1*b*, and where the top surface areas of four tile assemblies 1*b* essentially equal the top surface area of one tile assembly 1*a*. The pitch, shape and size of the openings in the crossbeams of the joining elements 2*a* and 2*b* are the same, so that the joining elements 2*a* and 2*b* may be combined in constructing a floor with tile assemblies 1*a*, 1*b*, which may each have tile members made from different materials.

When constructing a tile floor of which FIG. 6 shows a part, first each tile assembly 1*a*, 1*b* is connected to the corresponding joining element 2*a*, 2*b*, respectively, to provide pre-assembled tile-setting components. Subsequently, these pre-assembled tile-setting components are interconnected to obtain the tile floor. As can be seen in FIG. 6, it is not necessary to ensure that four corners of four adjacent tile assemblies are located at the same point; also staggered patterns of tile assemblies may be made.

Figure 8:
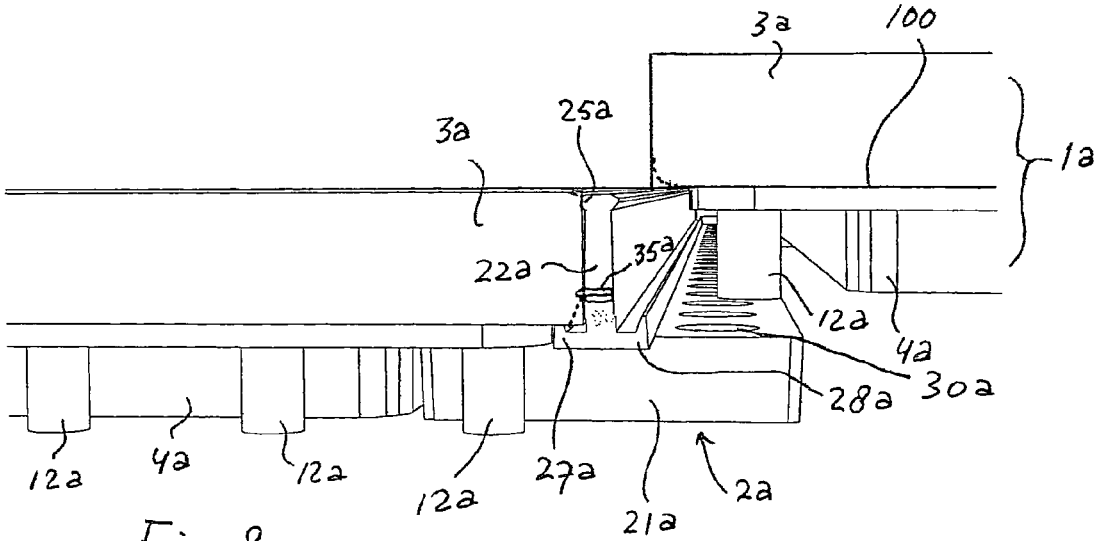
FIG. 8 shows a front view of two tile assemblies and a joining element according to the present invention.

In the floor of which FIG. 6 shows a part, liquid-tight connections are obtained, as elucidated by reference to FIG. 8. FIG. 8 illustrates that in the interconnection of a tile assembly 1*a* and a joining element 2*a* (by inserting projections 12*a* into openings 30*a*), the protrusions 25*a* and 27*a* are deformed and thereby compressed to provide a liquid-tight seal between the joining element 2*a* and a tile member 3*a* at two lines along (part of) the circumference of the tile member 3*a*. As further illustrated by FIG. 8, the height of the central beam 22*a* is essentially slightly less than the height of the tile member 3*a* to provide the floor with a joint part which is approximately at the same level as the top surface of the tile member 3. As can be still further seen from FIG. 8, a horizontally extending peripheral portion of the support member 4*a* of the tile assembly 1*a* in a mounted position rests against the top surface of the crossbeam 21*a*, outside the area of the protrusions 27*a*, 28*a*. However, it is also possible for said peripheral portion of the support member 4*a* to rest upon said protrusions 27*a*, 28*a*.

Like in other embodiments shown or discussed herein, between the tile member and the support member, a liquid-tight foil may be provided. Such a foil is indicated with 100 in FIG. 8. Should the tile member break, enabling liquid to pass through the tile member, then the foil will prevent the liquid from passing under the tile assembly.

Like in other embodiments shown or discussed herein, the tile member may be rounded off or tapered at its lower edges, as indicated in FIG. 8 by dotted lines. Such a design facilitates the replacement of a broken or otherwise damaged or worn tile assembly in an otherwise complete floor, by ensuring that the lower edges of the tile member easily pass into a tile assembly opening left in an otherwise complete floor after removing a tile assembly therefrom.

Figure 9:
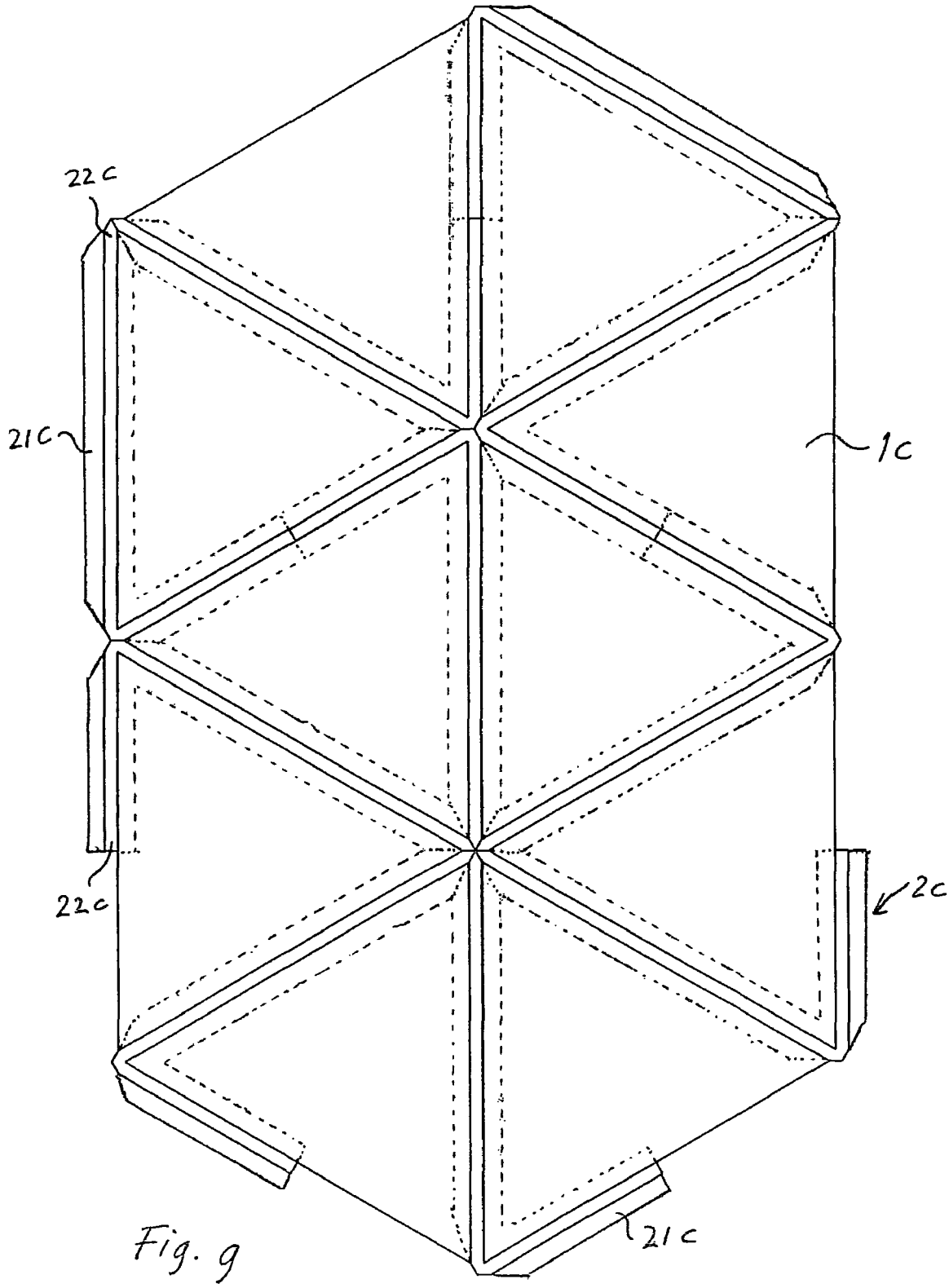
FIG. 9 shows a top view of a section of a floor built from triangular tile assemblies according to the present invention, interconnected by joining elements extending along half the circumference of the tile assemblies.

FIG. 9 illustrates a part of a floor made from triangular tile assemblies 1*c* and joining elements 2*c*. Each joining element 2*c* extends essentially along half of the circumference of the corresponding tile assembly 1*c*, i.e. along one full side of the tile assembly 1*c* and along half of an adjacent side of the tile assembly 1*c*. For clarity, openings in crossbeams 21*c* of the joining elements 2*c* have been omitted. Central beams 22*c* of the joining elements 2*c* form joints between the tile assemblies 1*c*. Protrusions may be provided similar to the protrusions 25, 25*a*, 26, 26*a*, 27, 27*a*, 28, 28*a*, 35, and 35*a* as shown and explained above.

Figure 10:
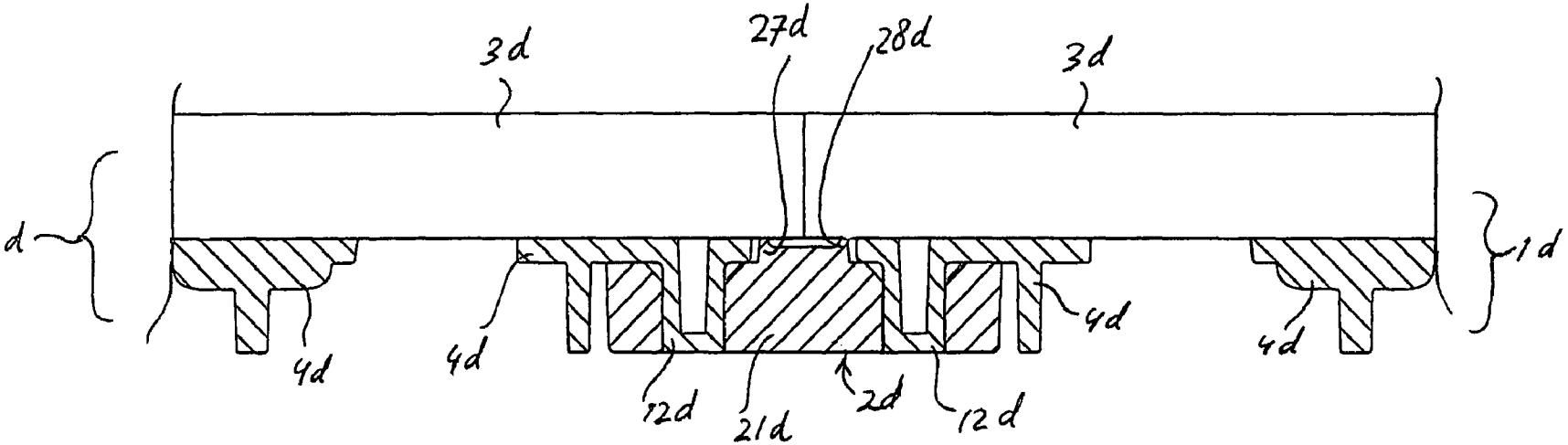
FIG. 10 shows a partial cross-section of two tile assemblies and a joining element without a joint part according to the present invention.

FIG. 10 shows a system comprising a joining element 2*d* interconnecting two tile assemblies 1*d*. Each tile assembly 1*d* comprises a tile member 3*d* and a support member 4*d*. The support members 4*d* are provided with rows of projections 12*d* engaging in rows of openings of the joining element 2*d*.

According to FIG. 10, the joining element 2*d* essentially comprises only a crossbeam 21*d*, and does not comprise a central beam as shown in previous Figures. Thus, adjacent edges of the tile members 3*d* abut. The joining element 2*d* is provided with two protrusions 27*d*, 28*d*, which each are compressed by a tile member 3*d* resting on it. The protrusions 27*d*, 28*d* may act as seals against a liquid entering between the abutting edges of the tile members 3*d* from reaching the underside of the tile assemblies 1*d*.

Figure 11:
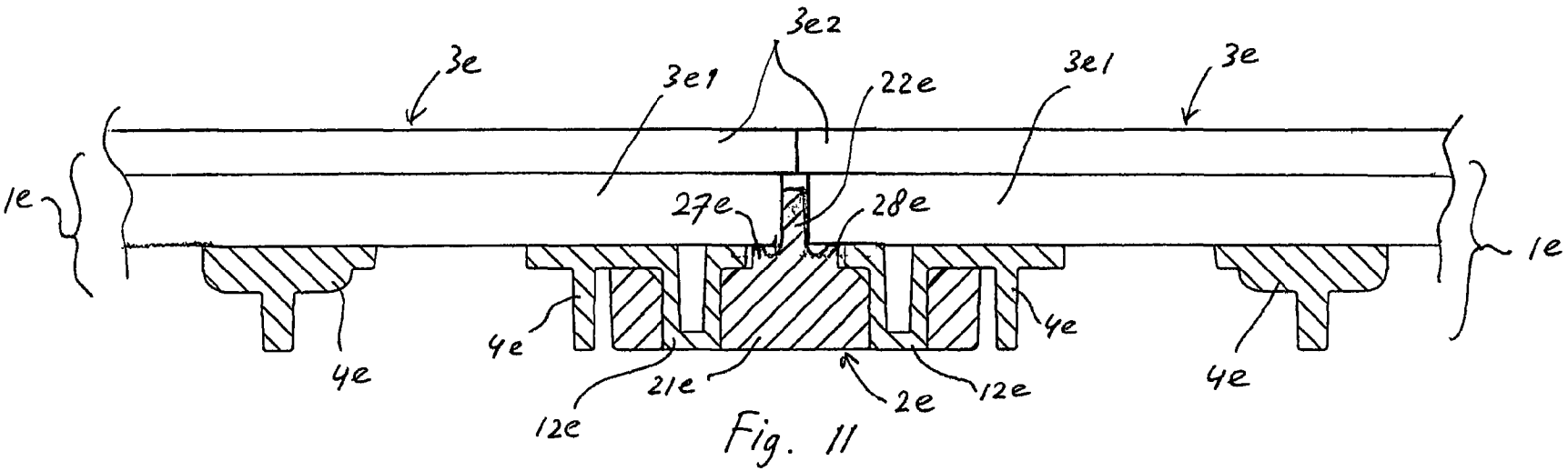
FIG. 11 shows a partial cross-section of two tile assemblies and a joining element with a joint part according to the present invention.

FIG. 11 shows a system comprising a joining element 2*e* interconnecting two tile assemblies 1*e*. The joining element comprises a crossbeam 21*e* and a central beam 22*e*. Each tile assembly 1*e* comprises a tile member 3*e* and a support member 4*e*. The support members 4*e* are provided with rows of projections 12*e* engaging in rows of openings of the joining element 2*e*.

The tile member 3*e* is composed of two different types of tiles: a tile 3*e*1 made of an essentially undeformable material, and a tile 3*e*2 made of an essentially undeformable material, or from a deformable material. Adjacent edges of the tiles 3*e*1 of the tile member 3*e* abut opposite sides of the central beam 22*e* of the joining element 2*e*. Adjacent edges of the tiles 3*e*2 of the tile member 3*e* abut each other. The joining element 2*e* is provided with two protrusions 27*e*, 28*e*, which each are compressed by the tile 3*e*1 resting on it. The central beam 22*e* and the protrusions 27*e*, 28*e* may act as seals against a liquid entering between the abutting edges of the tiles 3*e*2 from reaching the underside of the tile assemblies 1*e*.

Referring to the previous Figures, it should be understood that the bottom side of the crossbeam of the respective joining elements will act as a seal with respect to an underfloor to prevent a liquid inadvertently reaching under a tile assembly, e.g. through a crack in a tile, from spreading from under one tile assembly to under an adjacent tile assembly.

It is possible to launch the tile assemblies and joining elements on the market not as separate units, but as pre-assembled tile-setting components as they are still to be used without exception in actual practice.

It should be noted that the present invention allows to remove a single tile assembly from a floor already tiled, without it being required that for this purpose neighboring tile assemblies be removed or that the entire floor be broken up, which would result in major disadvantages or damages. With the present invention, a tile assembly can exactly be removed, and easily be replaced.

Although the above description focuses on the use of the system according to the invention for constructing a tile floor, in particular a horizontally extending tile floor or an inclined tile floor, it is noted that the same or similar system may be used in constructing a (e.g. essentially vertically extending) tile wall, where the tile assemblies and/or the joining elements are attached to a wall in a suitable manner.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The above description relates to embodiments of the invention, but it will be obvious that numerous modifications may be made without departing from the essential inventive idea as claimed.

What is claimed is:

1. A system for setting a tile floor, the system comprising:

a. a plurality of floor tile assemblies, each floor tile assembly comprising:

i. a floor tile member including a top surface, a bottom surface and a perimeter thereabout;

ii. a support member having a perimeter edge thereabout, wherein the support member is separate from the floor tile member, the support member is attached to the bottom surface of the floor tile member, said perimeter edge of the support member is located at the perimeter of the floor tile member or within the perimeter of the floor tile member, the support member is provided with at least one recess located by said perimeter edge of the support member and under the floor tile member, the support member includes a row of openings and/or a row of projections located in said at least one recess and extending in a direction perpendicular to said bottom surface of the floor tile member, b. a plurality of joining elements configured to interconnect adjacent floor tile assemblies, wherein each joining element comprises:

i. a central beam;

ii. a cross-beam extending perpendicularly to said central beam and having a bottom surface, wherein said cross-beam includes a row of openings and/or a row of projections located on either side of said central beam, and extending in a direction perpendicular to said bottom surface of said cross-beam, wherein, when the joining element interconnects two adjacent floor tile members:

i. openings of the support member mate with projections of the joining element, or projections of the support member mate with openings of the joining element;

ii. said central beam extends between said two adjacent floor tile members, and abuts the perimeters of said two adjacent floor tile members.

2. The system of claim 1, wherein part of the floor tile assembly overlies part of the joining element.

3. The system of claim 1, wherein the projection has a substantially cylindrical shape, the projection being configured to be inserted into an opening having a substantially cylindrical shape, the opening having an inlet part with a substantially conical shape.

4. The system of claim 1, wherein each of the projections has a tapering shape, each of the projections is configured to be inserted into an opening having a corresponding tapering shape.

5. The system of claim 1, wherein the support member is provided with the row of projections, and the joining element is provided with the corresponding row of openings.

6. The system of claim 1, wherein the joining element is configured to extend along part of the circumference of the floor tile assembly.

7. The system of claim 6, wherein the joining element is configured to extend along half the circumference of the floor tile assembly.

8. The system of claim 1, wherein the joining element is made from an elastically deformable material.

9. The system of claim 8, wherein the row of openings and/or the row of projections of the floor tile assemblies and the joining elements are configured such that with a joining element interconnecting adjacent floor tile assemblies, the joining element is deformed, thereby urging the floor tile members of the adjacent floor tile assemblies towards the central beam.

10. The system of claim 1, wherein the central beam is made of an elastically deformable material.

11. The system of claim 1, wherein the central beam is integral with the joining element.

12. The system of claim 1, wherein a top part of the central beam is tapered or rounded.

13. The system of claim 1, wherein the joining element is provided with a protrusion on a side configured to face a floor tile member, the protrusion extending along the length of the joining element.

14. The system of claim 13, wherein the protrusion is compressible.

15. The system of claim 1, wherein the joining element is configured to have a bottom side lying essentially flush with a bottom side of the support member.

16. The system of claim 1, wherein the floor tile member comprises a substantially undeformable floor tile, the floor tile being made from stone, ceramics, wood, plastic, glass, metal, or any combination thereof.

17. The system of claim 16, wherein the floor tile at its lower edges is tapered or rounded.

18. The system of claim 1, wherein the floor tile member comprises a rubber tile or a carpet tile.

19. The system of claim 1, wherein the floor tile member comprises a layered structure of an undeformable lower floor tile and an upper floor tile, the upper floor tile overlying at least part of the central beam.

20. The system of claim 1, wherein between the floor tile member and the support member a liquid-tight material is provided.

21. The system of claim 20, wherein the material is a foil.

22. The system of claim 1, wherein the joining element has an inverted T-shaped cross-section.

23. The system of claim 1, wherein the projection is in the form of a hollow cylinder.

24. The system of claim 1, wherein the bottom surface of each floor tile member is attached to each of the support members by an adhesive.

25. The system of claim 1, wherein the support member has a plurality of sides, wherein the support member has one recess located along each of said plurality of sides, wherein said recess is located under the floor tile member to accommodate parts of joining elements within said perimeter edge of said support member.

26. The system of claim 1, wherein said at least one recess of the support member has a first edge extending perpendicularly to a second edge, said second edge extends from said first edge to said perimeter edge, said second edge extends parallel to said bottom surface of said floor tile member.

27. The system of claim 26, wherein opening and/or projection extends from said second edge in the at least one recess of the support member.

28. A method of setting a tile floor, the method comprising:

a. providing a plurality of floor tile assemblies, each floor tile assembly comprising:

i. a floor tile member including a top surface, a bottom surface and a perimeter thereabout;

ii. a support member having a perimeter edge thereabout, wherein the support member is separate from the floor tile member, the support member is attached to the bottom surface of the floor tile member, said perimeter edge of the support member is located at the perimeter of the floor tile member or within the perimeter of the floor tile member, the support member is provided with at least one recess located by said perimeter edge of the support member and under the floor tile member, the support member includes a row of openings and/or a row of projections located in said at least one recess and extending in a direction perpendicular to said bottom surface of the floor tile member, b. providing a plurality of joining elements, each joining element comprising:

i. a central beam;

ii. a cross-beam extending perpendicularly to said central beam and having a bottom surface, wherein said cross-beam includes a row of openings and/or a row of projections located on either side of said central beam, and extending in a direction perpendicular to said bottom surface of said cross-beam, c. connecting a first joining element to a first floor tile assembly, by mating openings of the support member of the first floor tile assembly with projections of the first joining element, or by mating projections of the support member of the first floor tile assembly with openings of the first joining element, wherein the central beam of the first joining element abuts the perimeter of the floor tile member of the first floor tile assembly; and d. connecting a second floor tile assembly to the first joining element, by mating openings of the support member of the second floor tile assembly with projections of the first joining element, or by mating projections of the support member of the second floor tile assembly with openings of the first joining element, wherein the central beam of the first joining element abuts the perimeter of the floor tile member of the second floor tile assembly, whereby said central beam extends between the floor tile members of the first and second floor tile assemblies, and said central beam abuts the perimeters of the floor tile members of the first and second floor tile assemblies.

29. A method of repairing a tile floor, the tile floor comprising:

a. a plurality of floor tile assemblies, each floor tile assembly comprising:

i. a floor tile member including a top surface, a bottom surface and a perimeter thereabout;

ii. a support member having a perimeter edge thereabout, wherein the support member is separate from the floor tile member, the support member is attached to the bottom surface of the floor tile member, said perimeter edge of the support member is located at the perimeter of the floor tile member or within the perimeter of the floor tile member, the support member is provided with at least one recess located by said perimeter edge of the support member and under the floor tile member, the support member includes a row of openings and/or a row of projections located in said at least one recess and extending in a direction perpendicular to said bottom surface of the floor tile member, b. a plurality of joining elements configured to interconnect adjacent floor tile assemblies, wherein each joining element comprises:

i. a central beam;

ii. a cross-beam extending perpendicularly to said central beam and having a bottom surface, wherein said cross-beam includes a row of openings and/or a row of projections located on either side of said central beam, and extending in a direction perpendicular to said bottom surface of said cross-beam, wherein, when each joining element interconnects two adjacent floor tile assemblies:

i. openings of the support members of said two adjacent floor tile assemblies mate with projections of the joining element, or projections of the support members of said two adjacent floor tile assemblies mate with openings of the joining element;

ii. said central beam extends between said two adjacent floor tile members, and abuts the perimeters of said two adjacent floor tile members, the method of repairing the tile floor comprising:

releasing connections between one of the plurality of floor tile assemblies and corresponding joining elements in the tile floor, by lifting said one of the plurality of floor tile assemblies from the tile floor, thereby leaving a floor tile assembly opening in the tile floor, inserting a further floor tile assembly in the floor tile assembly opening, thereby connecting said further floor tile assembly to said corresponding joining elements, and the central beams of said corresponding joining elements abutting the perimeter of the floor tile member of said further floor tile assembly.

* * * * *